US006297735B1

(12) United States Patent
Abel

(10) Patent No.: US 6,297,735 B1
(45) Date of Patent: Oct. 2, 2001

(54) LOCKED SHUT DOWN WITH REMOTE MONITORING OF LARGE EQUIPMENT

(76) Inventor: Jerry Abel, 158 Bridleglen Road SW., Calgary, Alberta (CA), T2Y 3W8

( * ) Notice: Subject to any disclaimer, the term of this patent is extended or adjusted under 35 U.S.C. 154(b) by 0 days.

(21) Appl. No.: 09/552,732

(22) Filed: Apr. 19, 2000

(51) Int. Cl.[7] ..... E05B 45/06

(52) U.S. Cl. ..... 340/542; 340/572.8; 340/539; 340/573.4

(58) Field of Search ..... 340/542, 572.8, 340/573.4, 539, 572.1

(56) References Cited

U.S. PATENT DOCUMENTS

| | | | | |
|---|---|---|---|---|
| 2,685,685 | | 8/1954 | Lathrop et al. . | |
| 3,303,457 | | 2/1967 | Åkesson . | |
| 4,663,611 | | 5/1987 | Humphrey . | |
| 4,853,692 | * | 8/1989 | Wolk et al. | 340/573 |
| 4,962,369 | * | 10/1990 | Close | 340/572 |
| 5,200,735 | * | 4/1993 | Hines | 340/539 |
| 5,512,879 | * | 4/1996 | Stokes | 340/573 |
| 5,534,847 | * | 7/1996 | McGregor | 340/572 |
| 5,617,072 | | 4/1997 | McNeal . | |
| 5,657,003 | | 8/1997 | Fuentes . | |

* cited by examiner

*Primary Examiner*—John Tweel
(74) *Attorney, Agent, or Firm*—Siemens Patent Services, LC

(57) ABSTRACT

A lock for locking valve and electrical switch handles in the "off" position, which lock incorporates a radio transmitter for reporting status of the lock to a remote monitor. The lock has a cable which encircles the handle. The distal end of the cable is connected to the lock and is locked in place. A conductor of an alarm subcircuit passes through the cable, thereby detecting whether the cable has been cut. The monitor includes a radio receiver and a display for displaying status of the monitored lock. The invention optionally utilizes plural locks and plural monitors.

10 Claims, 2 Drawing Sheets

LOCKED SHUT DOWN WITH REMOTE MONITORING OF LARGE EQUIPMENT

BACKGROUND OF THE INVENTION

1. Field of the Invention

The present invention relates to a security system including a cable which can be placed on a valve or switch handle to immobilize the same, a lock capable of retaining the cable, and a communications device which reports status of the lock to a remote monitoring station. The principal application of the invention is that of industrial safety in large facilities which handle piping systems having valves and electrical systems having switches. Oil refineries and other large scale fluid handling facilities, factories, large institutions, commercial and industrial facilities, and other facilities which require occasional shut down of piping systems and electrical power can benefit from the invention. The invention finds further utility in the field of security wherein unstaffed gates, ramps, doors, elevators, and similar transport devices must be locked and monitored remotely.

2. Description of the Prior Art

Large facilities having valves, switches, compactors, and other large scale material and energy handling systems require periodic maintenance. Maintenance typically requires that at least part of the material and energy handling systems be shut down to enable personnel to conduct necessary maintenance operations. In large scale piping systems, such as in oil refineries and chemical plants, manual valves are frequently employed to obstruct flow in piping. Such valves typically have handles which are rotated into the "closed" position. Electrical switches, such as safety switches, motor starters, circuit breakers, and custom control panels are similarly ordinarily provided with handles to shut off power.

Personnel charged with performing maintenance close valves and shut off power, where appropriate, and then undertake maintenance operations. In large scale facilities, the site of the actual work is frequently remote from the valves and electrical controllers which have been turned off. There exists a considerable hazard that someone not involved with the maintenance operation will come upon a valve, switch, or other controller, and restore the associated equipment to operative status.

This has potentially catastrophic consequences. Unexpected starting of even a single piece of equipment can cause severe injuries to a person who may have a limb in the path of moving or rotating parts. In the example of oil refineries and chemical plants, unexpected flow of combustible fluids can result in fires and explosions. Power turbines, pumps, and other rotating equipment, boilers, pressure vessel and tank closures, conveyors, hoists, and other equipment may be shut off with only ordinary controls, and thus become potentially sources of hazards should they suddenly be rendered operative. Obviously, the field of industrial safety requires safety procedures to prevent such occurrences.

Electrical switches such as safety disconnect switches and circuit breakers typically have provision for accepting padlocks enabling the switch to be locked in the "off" position. In the event that someone cuts through the shackle of the padlock, there is no way to annunciate the consequent change in condition to either personnel engaged in maintenance operations or to a central authority charged with oversight of operations.

The prior art has suggested security devices which detect unauthorized actions. U.S. Pat. No. 5,657,003, issued to Alfredo Fuentes on Aug. 12, 1997, describes a camera and computer based monitoring system which monitors a building wall. Should the wall undergo displacement of any type, images recorded by the camera are compared to data stored in the memory of the computer. Determination of a discrepancy triggers an alarm. By contrast, the present invention engages the object being monitored by direct contact with a cable, preventing the object from being moved to a predetermined position. The present invention further transmits an alarm signal should the object be freed from engagement. The cable is connected to its base apparatus at two ends. There is no corresponding structure in the device of Fuentes.

A bicycle lock is described in U.S. Pat. No. 4,663,611, issued to Chris W. Humphrey on May 5, 1987. The lock has an integral audible alarm which sounds if someone disables the lock. By contrast, the present invention sends a signal to a remote monitoring station to generate an alarm, rather than sounding an audible alarm. The present invention utilizes a locking cable as part of the electrical circuitry of the alarm. There is no corresponding structure in Humphrey.

A position signaling apparatus is shown in U.S. Pat. No. 5,617,072, issued to Dennis D. McNeal on Apr. 1, 1997. McNeal's apparatus comprises a sensing arm which projects from a motor vehicle. Unlike the present invention, the arm does not engage and immobilize an external object. Also, the arm does not connect to the apparatus at two points, as does a corresponding cable in the present invention.

U.S. Pat. No. 3,303,457, issued to Jan Assar Åkesson on Feb. 7, 1967, sets forth a position sensor for sensing control rods of a nuclear reactor. There is no structure which engages and limits motion of the rods in the device of Åkesson. By contrast, the present invention has a cable which engages and limits motion of a moving component of an environmental object.

U.S. Pat. No. 2,685,685, issued to Carl M. Lathrop on Aug. 3, 1954, describes a sensor and alarm for a pipeline pig. There is no structure which engages and limits motion of the pig in the device of Lathrop. By contrast, the present invention has a cable which engages and limits motion of a moving component of an environmental object.

None of the above inventions and patents, taken either singly or in combination, is seen to describe the instant invention as claimed.

SUMMARY OF THE INVENTION

The present invention sets forth a combined locking and signaling device suitable for immobilizing manual controls of valves, switches, and other objects which may be engaged by a flexible cable. The device includes a housing, a cable which projects from the housing at its proximal end and removably engages the housing at its distal end, an integral signaling device, and electrical circuitry including a battery. The locking and signaling device is ideally suited for universal application to all objects which are so constructed that a flexible cable may be interengaged with elements of the objects. Illustratively, the cable may be passed through a hand wheel of a valve such that the wheel may be effectively tied down and thus constrained against being opened. The same device is equally applicable in immobilizing a handle of a circuit breaker, safety disconnect switch, or other electrical controller adapted to receive a padlock. Still other devices, such as gates, ramps, elevators, and other structures having openings which can receive the cable of the novel device are susceptible to being immobilized by engagement with the cable, which is then tied to suitable anchorage.

The novel device includes signaling apparatus. Although it may be hardwired both to derive power and to pass signals, it preferably contains a battery and a radio frequency transmitter or other transmitter of energy signals. In the latter form, it is independent of connection, and is portable and readily installed. Signals are generated both periodically to advise that the locking device remains in the locked condition, and also if the lock should be opened or the cable cut. In addition to signals transmitted to a remote monitoring station, the device has an alarm light to advise that the lock is in the locked condition. This feature warns those not directly involved with the maintenance operation that there is a reason that the affected valve, switch, or other equipment must remain inoperative.

The novel device may be employed in any number, each signaling a remote monitoring station which enables a single person to oversee a large facility which may require many such locking and signaling devices. This answers an unsatisfied need in large scale industrial facilities. Even though a central monitoring or control station is provided in many facilities, there has heretofore been no satisfactory way of signaling current conditions of many monitored valves, switches, and other equipment to the central station. Because of its portability and universal ability to engage many different types of objects, the present invention answers this longstanding need.

Accordingly, it is one object of the invention to provide a combined locking and signaling device.

It is another object of the invention that the locking and signaling device be universally usable with diverse types of equipment.

It is a further object of the invention to provide wireless communication from the locking device to a remote monitoring station.

Still another object of the invention is to provide a local warning signal that equipment must remain inoperative.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
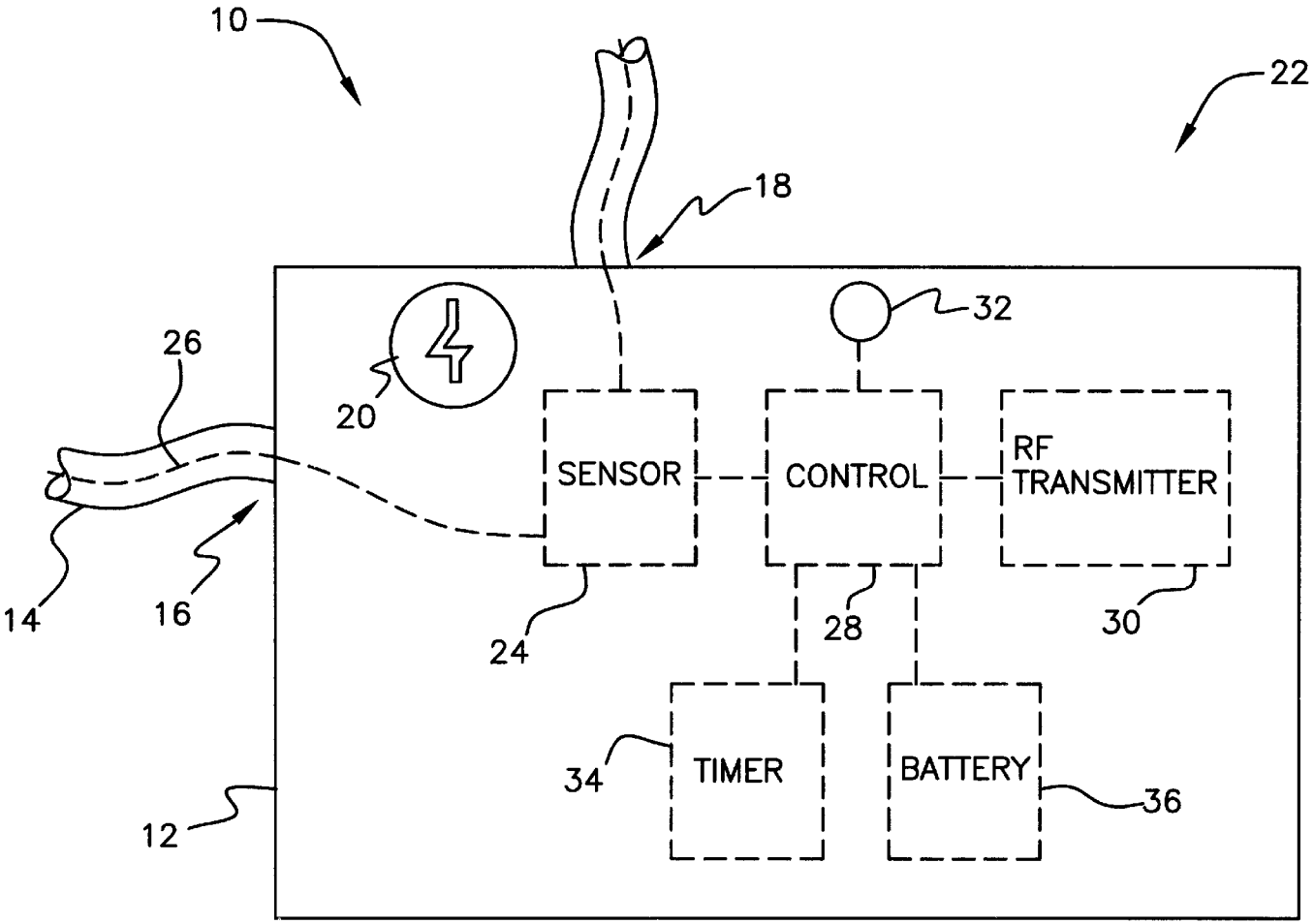
FIG. 1 is a diagrammatic side elevational view of an embodiment of a locking and signaling device according to the invention.

FIG. 1 of the drawings illustrates a locking and signaling device 10 for locking large equipment (see FIG. 2) of an industrial facility in an inoperative condition. Device 10 comprises a housing 12 having a shackling member projecting therefrom. The shackling member may if desired comprise a U-shaped rigid member similar to the shackle of a padlock (not shown). Preferably, the shackling member is a flexible cable 14 which can be wound around and through openings formed in handles of different configurations, so that device 10 is nearly universally in its ability to engage handles of valves, switches, and other objects which are to be immobilized in an inoperative position or condition.

Cable 14 has a proximal end 16 connected permanently to housing 12, and a distal end 18 removably connectable to housing 12. An intermediate length of cable 14 spaced apart from housing 12 spans ends 16, 18. Distal end 18 is received in a socket formed in housing 12. The socket incorporates a key operated lock 20 having a member (not separately shown) engaging and retaining distal end 18 within the socket. In the depiction of FIG. 1, distal end 18 of cable 14 is shown in a connected, locked condition relative to housing 12. Once released by operating lock 20, distal end 18 may be removed from the socket, whereupon distal end will be understood to be in an unconnected, unlocked condition (not shown) relative to housing 12.

Device 10 includes a signal generator communicably linked to lock 20. The signal generator generates a radio frequency signal, or any inaudible, invisible energy signal indicative of cable 14 being in the unconnected, unlocked condition. To this end, the signal generator includes electrical circuitry 22 including a sensor 24 disposed to sense whether distal end 18 of cable 14 is received within the socket and engaged by elements of lock 20. Sensor 24 can comprise a proximity switch (not shown) or any known sensor for accomplishing the objective set forth above. Sensor 24 includes a subcircuit representatively shown as comprising conductor 26 which passes through cable 14. Sensor 24 is arranged such that the unconnected, unlocked condition will be signaled if continuity of conductor 26 is broken. Sensor 24 communicates with a control 28 which activates a radio frequency transmitter 30 should the unconnected, unlocked condition be detected by sensor 24. Concurrently, an indicating lamp 32 is illuminated when the connected, locked condition of cable 14 is sensed.

Control 28 also initiates a second radio frequency signal whenever lock 20 is in the locked position and sensor 24 fails to sense the unconnected, unlocked condition. A timer 34 is arranged to activate this second signal periodically. A battery 36 contained within housing 12 is electrically connected to control 28 and to the other electrically operated components of circuitry 22 as required to supply power for operation. If desired, device 10 can include a hard wired connection for permanent installation on equipment being monitored. However, it is preferred that device 10 be portable and independent of connection to external electrical power.

In summary, device 10 can operate in any one of three modes of operation. In the first mode, a signal indicates the unconnected, unlocked condition when lock 20 is locked. This situation usually corresponds to unauthorized removal of device 10 from the monitored equipment, and constitutes the single most prevalent hazardous condition in large industrial plants today. In a second mode, a signal indicates the connected, locked condition which confirms safe condition of the monitored equipment. In a preferred embodiment, two different signals may be generated, one corresponding to the unconnected, unlocked condition and the other corresponding to the connected, locked condition. Thus positive indication of status is provided regardless of which condition prevails. The signal is transmitted away from device 10 to a remote monitoring station.

Figure 2:
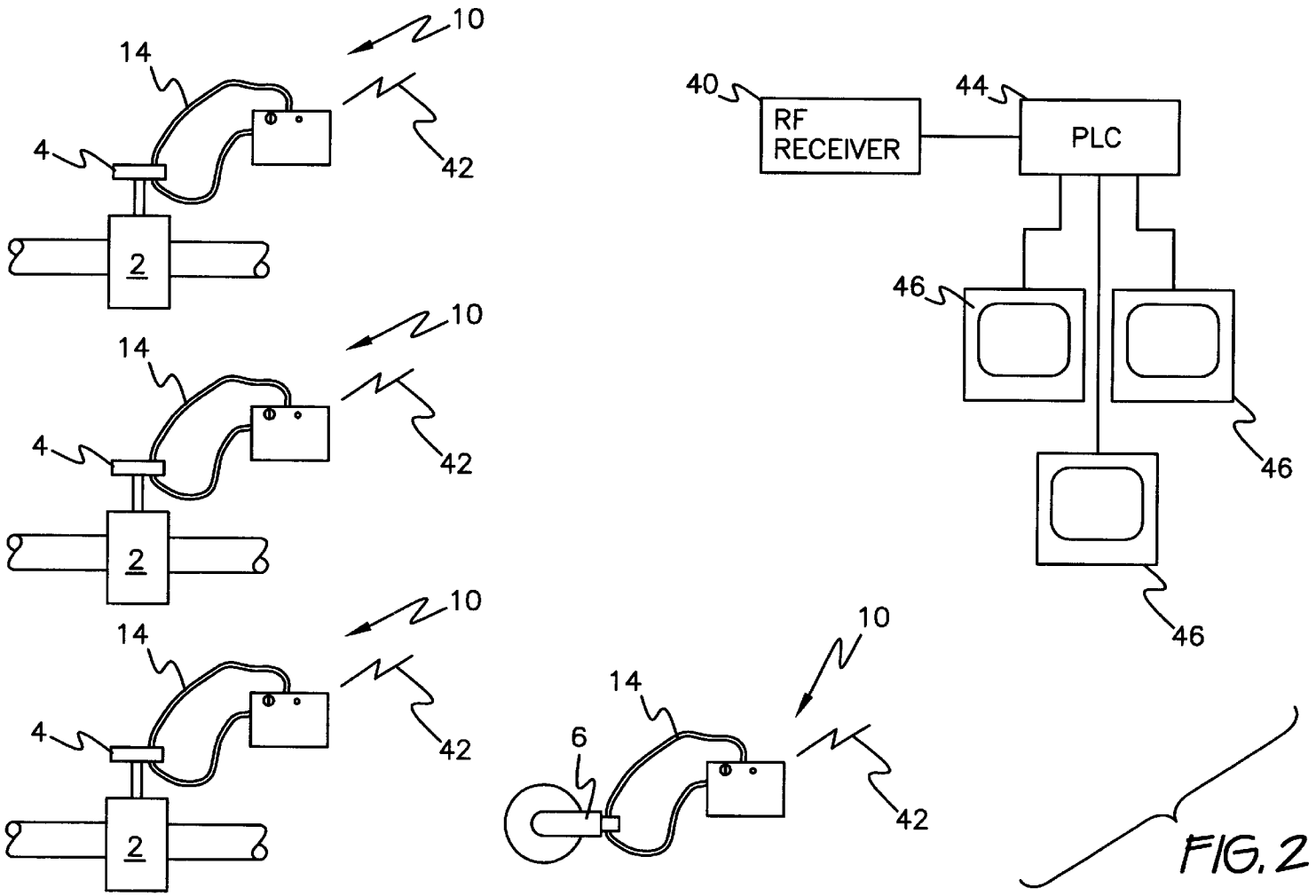
FIG. 2 is a diagrammatic representation of a plurality of locking and signaling devices incorporated into a monitoring system overseeing operation of an industrial facility.

FIG. 2 illustrates an exemplary industrial facility wherein a plurality of devices 10 are operably attached to units of equipment being shut down and monitored. In the scheme of FIG. 2, devices 10 form part of a locking and monitoring system for shutting down fluid and energy handling equipment of an industrial facility. The fluid and energy handling equipment are shown representatively as valves 2 having wheel handles 4, and a switch (not shown in its entirety) having a handle 6. Cables 14 of devices 10 are wound through handles 4, 6 such that handles 4, 6 are constrained to remain in the "closed" or "off" positions. Devices 10 will be understood to be fixed to secure points of anchorage where this condition is necessary to disable the monitored equipment.

The industrial facility has an energy receiving element such as radio frequency receiver 40 disposed to receive signals 42 generated by devices 10. Receiver 40 is communicably linked to a programmable logic controller 44 which in turn controls three monitors 46. Monitors 46 will be understood to include a display screen for displaying data as an image which is readily interpreted by an observer. Illustratively, monitors 46 may be cathode ray tubes of a personal computer linked to controller 44.

In a typical large scale industrial facility, each monitor is remotely located from each device 10. A human observer stationed at a monitor can be apprised of the condition of every valve 2 and switch 6 closed and monitored by a device 10. In the preferred embodiment depicted in FIG. 2, several different and separated monitoring stations are served by monitors 46 each of which annunciates the condition prevailing at each locking and signaling device 10.

The present invention is susceptible to variations and modifications which may be introduced thereto without departing from the inventive concept. For example, the locks may be remotely operated from the monitoring station if desired. Signals may be optical, pneumatic, or may take still other forms if desired.

It is to be understood that the present invention is not limited to the embodiments described above, but encompasses any and all embodiments within the scope of the following claims.

I claim:

1. A reusable apparatus for disabling an actuator of an industrial control, comprising:

a) an elongated shackling member adapted for interaction with an actuator of an industrial control to prevent operative movement of said actuator;

b) a housing for fixedly retaining the distal end of said elongated shackling member and selectively, lockably retaining and releasing the proximal end thereof in said housing;

c) circuit means for detecting when said proximal end of said elongated shackling member is lockably retained in said housing and when said proximal end of said elongated shackling member is released therefrom;

d) tamper detection means, operatively connected to said circuit means, for indicating when said shackling member has been cut or stretched beyond a predetermined limit; and e) signal generation means disposed within said housing and operatively connected to said circuit means and said tamper detection means and adapted for generating an inaudible, invisible signal responsive to a predetermined state of said circuit means and said tamper detection means.

2. The reusable apparatus for disabling an actuator of an industrial control as recited in claim 1, wherein said industrial control comprises at least one from the group: valve, circuit breaker, cut-out switch.

3. The reusable apparatus for disabling an actuator of an industrial control as recited in claim 1, wherein said shackling means comprises a flexible cable.

4. The reusable apparatus for disabling an actuator of an industrial control as recited in claim 1, wherein said signal generation means comprises a radio frequency (RF) transmitter, and where said invisible signal comprises an RF signal.

5. The reusable apparatus for disabling an actuator of an industrial control as recited in claim 4, wherein said RF signal comprises an intermittent RF signal transmitted at a predetermined periodicity.

6. A method for disabling an actuator of an industrial control and remotely monitoring said actuator to determine that said actuator remains in a disabled state, the steps comprising:

a) providing an apparatus having an elongated shackle adapted for interaction with an actuator of an industrial control so as to prevent movement of said actuator, a housing for fixedly retaining a distal end of said shackle and releasably locking a proximal end thereof, said apparatus being adapted to provide a signal indicating when said proximal end of said shackle is locked within said housing;

b) placing said actuator in a predetermined position;

c) restraining the actuator in said predetermined position with said shackle;

d) locking said distal end of said shackle in said housing;

e) activating said apparatus whereby a predetermined signal is emitted by said apparatus as long as said shackle secures said actuator in said predetermined position; and f) remotely monitoring said predetermined signal at a remote monitoring site;

whereby a person at said remote monitoring site may determine that said proximal end of said shackle remains locked in said housing.

7. The method for disabling an actuator of an industrial control and remotely monitoring said actuator to determine said actuator remains in a disabled state as recited in claim 6, wherein said industrial control comprises at least one from the group: valve, circuit breaker, cut-out switch.

8. The method for disabling an actuator of an industrial control and remotely monitoring said actuator to determine said actuator remains in a disabled state as recited in claim 6, wherein said shackling means comprises a flexible cable.

9. The method for disabling an actuator of an industrial control and remotely monitoring said actuator to determine said actuator remains in a disabled state as recited in claim 6, wherein said predetermined signal comprises a radio frequency (RF) signal.

10. The method for disabling an actuator of an industrial control and remotely monitoring said actuator to determine said actuator remains in a disabled state as recited in claim 9, wherein said RF signal comprises an intermittent RF signal transmitted at a predetermined periodicity.

* * * * *